United States Patent [19]

Lawrence

[11] 4,358,042

[45] Nov. 9, 1982

[54] WIRE STITCHERS

[75] Inventor: Brian R. Lawrence, Olney, Great Britain

[73] Assignee: Xerox Corporation, Stamford, Conn.

[21] Appl. No.: 106,193

[22] Filed: Dec. 21, 1979

[30] Foreign Application Priority Data

Dec. 29, 1978 [GB] United Kingdom ..... 50323/78

[51] Int. Cl.[3] ..... B42B 4/00

[52] U.S. Cl. ..... 227/152; 227/155

[58] Field of Search ..... 227/155, 152, 90

[56] References Cited

U.S. PATENT DOCUMENTS

| | | | |
|---|---|---|---|
| 2,964,749 | 12/1960 | Kwasniewski et al. | 227/155 |
| 2,987,729 | 6/1961 | Taynton | 1/220 |
| 3,804,317 | 4/1974 | Gelzer | 227/155 |
| 3,986,533 | 10/1976 | Woodman, Jr. | 140/105 |

FOREIGN PATENT DOCUMENTS

| | | | |
|---|---|---|---|
| 22981 | of 1895 | United Kingdom | 227/155 |
| 281986 | 12/1927 | United Kingdom . | |
| 406752 | 3/1934 | United Kingdom . | |
| 462957 | 3/1937 | United Kingdom . | |
| 541833 | 12/1941 | United Kingdom . | |
| 794172 | 4/1958 | United Kingdom . | |
| 877596 | 9/1961 | United Kingdom . | |
| 885841 | 12/1961 | United Kingdom . | |
| 964124 | 7/1964 | United Kingdom . | |

*Primary Examiner*—Paul A. Bell

*Attorney, Agent, or Firm*—Bernard A. Chiama

[57] ABSTRACT

A wire stitcher for binding sets of sheets has a driver for driving a staple through a set and an active clincher. In one form the clincher has a drive for the clincher ears which is actuated by the driver. The drive is by a spring which is loaded during a return motion of the clincher housing at the completion of a stitching operation. In another form the clincher ear drive is effected by a cam. Both forms are capable of accommodating variations in set thickness essentially without affecting the timing of the operation of the clincher ears.

7 Claims, 7 Drawing Figures

Figure 1:
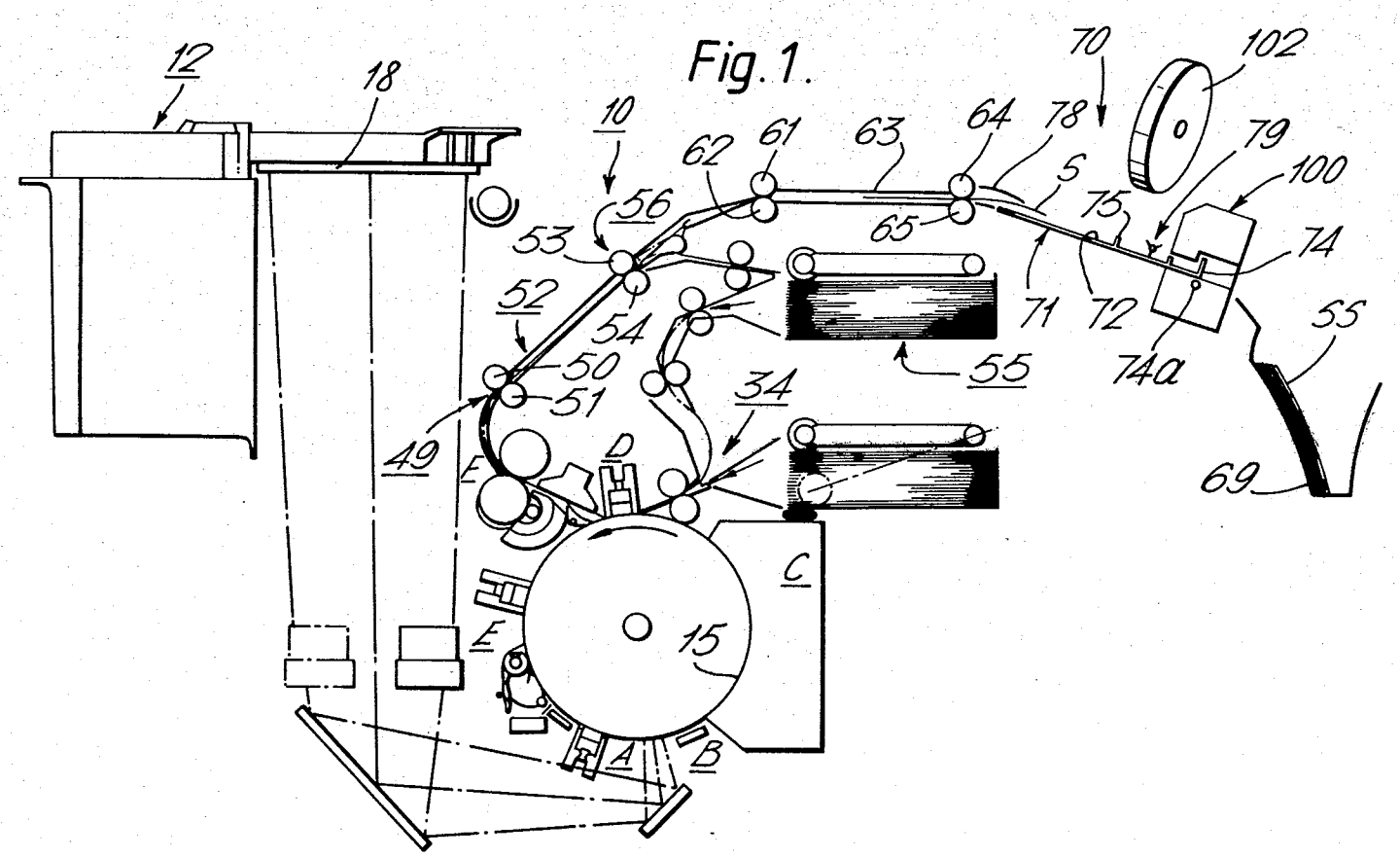

105
106
105
107
108
104
W
104a

120
W
103
120
123
122
124
55
106
109
125
121
138
139
202
206
210
205
205
204
105
110
104
101
203
208
201
207
217
209

107'
190
173
105'
170
106'
104'
104a'
72
124'
149
144
145
74
143
201'
202'
146
206'
148
147
205'
211'
253
213'
207'
255
254
270
209'
252
219
219a
251
218
250

WIRE STITCHERS

This invention relates to wire stitchers and particularly to such apparatus for binding sets or signatures of sheets or documents. Stitchers take various well-known forms. There are those (called staplers) which use preformed staples, those using pre-cut lengths of wire which are formed in the machine and those in which the staples are formed from a continuous wire wound on a spool from which pieces are cut are formed in the machine. In each case the legs of the formed staple or stitch are driven through the set until the crown of the staple lies against one face of the set and the ends of the staple legs are bent over against the opposite face of the set to form clinches. The present invention is concerned with stitchers of all the above kinds.

More particularly this invention is concerned with stitchers having active clinchers that is to say clinchers having ears which are positively driven to bend the staple legs against the set. Examples of stitchers having active clinchers are shown in U.S. Pat. Nos. 2,964,749, 2,987,729, 3,804,317 and 3,986,533. The present invention is directed to various aspects of the drive to the clincher ears and, from one aspect, provides a stitcher for binding sets of sheets, having a stitcher head for driving a staple through a set and an active clincher movable towards and away from the stitcher head between an operative position in which a set is clamped thereby relative to the stitcher head and an inoperative position, wherein the drive to the clincher ears is by a spring which is loaded during movement of the clincher away from the head, actuation of the clincher ear drive being effected in timed relation to the driving of a staple.

This aspect of the invention is exemplified by one specific embodiment of stitcher described below with reference to the drawings which also exemplifies a second aspect of the invention according to which there is provided a stitcher for binding sets of sheets in which a set is clamped between clamping surfaces associated respectively with a stitcher head having a driver for driving a staple through the set and an active clincher having a clincher ear drive which is actuated by the driver.

It will be understood that where the stitcher is capable of accommodating sets of varying thickness, the position of the clincher relative to the head will vary according to set thickness and a further aspect of the invention is concerned with providing a drive to the clincher ears the timing of which relative to the driving of the staple is effectively unaffected by the variations in set thickness. Thus, from a further aspect, the invention provides a stitcher for binding sets of sheets having a stitcher head for driving a staple through a set and an active clincher movable towards and away from the stitcher head between an operative position in which a set is clamped thereby relative to the stitcher head an an inoperative position, wherein the head has a fixed operative position and the movement of the clincher is automatically variable to accommodate variations in set thickness, and wherein the drive to the clincher ears is effected in substantially the same timed relation to the driving of a staple regardless of the thickness of the set. Such aspect of the invention is exemplified by both specific embodiments described below with reference to the drawings.

The stitcher may be incorporated with a sheet stitcher/compiler as part of a finisher for a photocopier and such a finisher may form part of the photocopier or take the form of a separate unit.

Figures 2, 3:
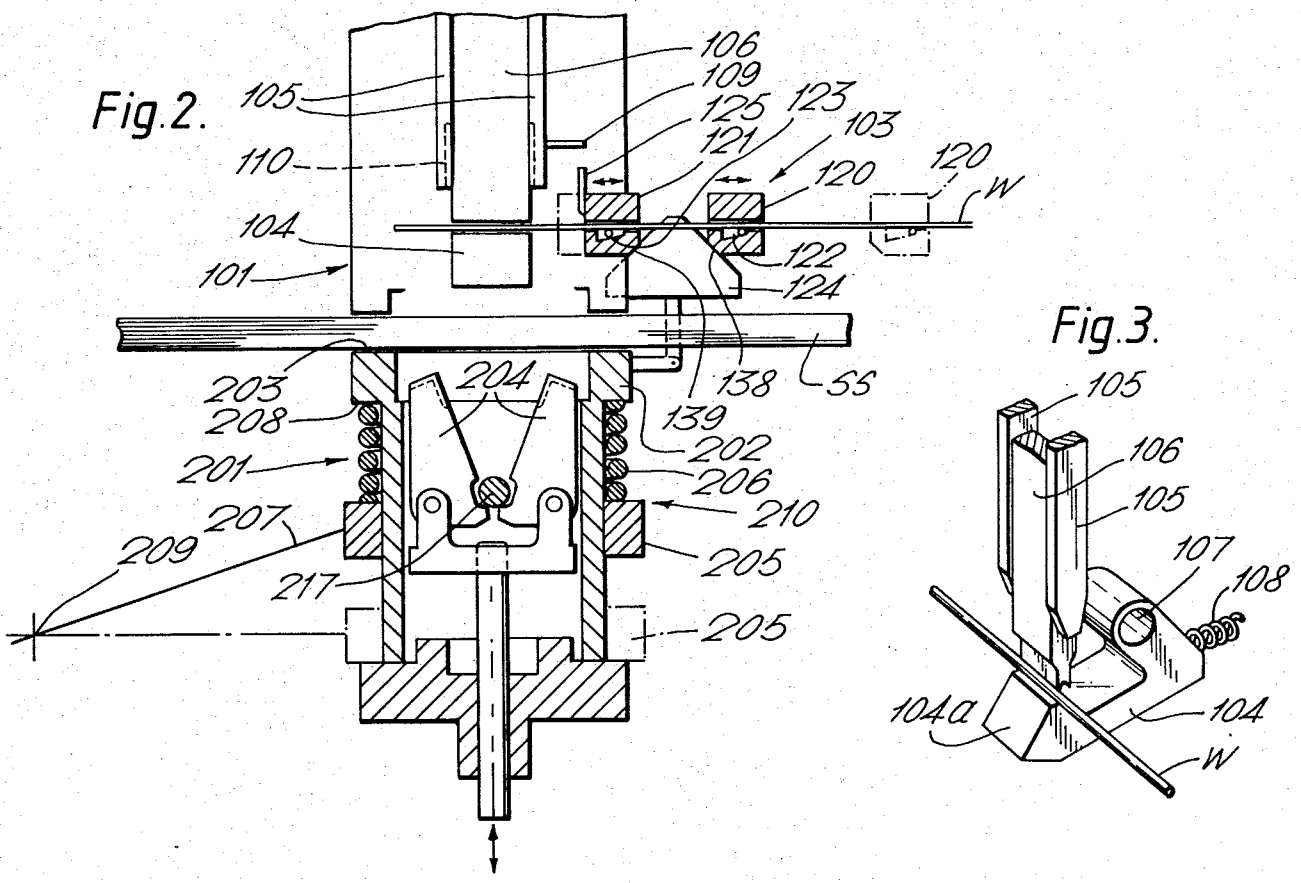
Figure 4:
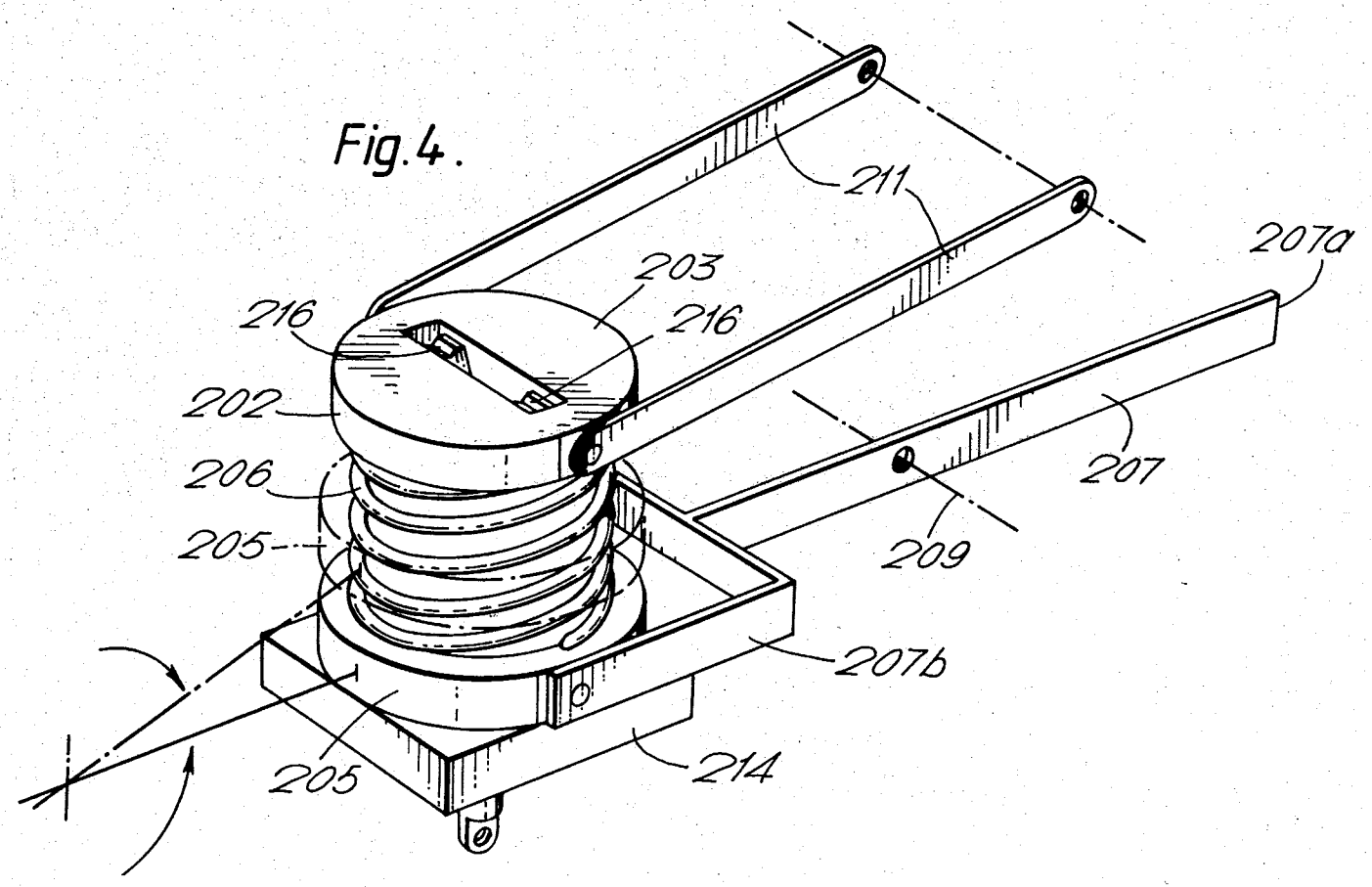
Figure 5:
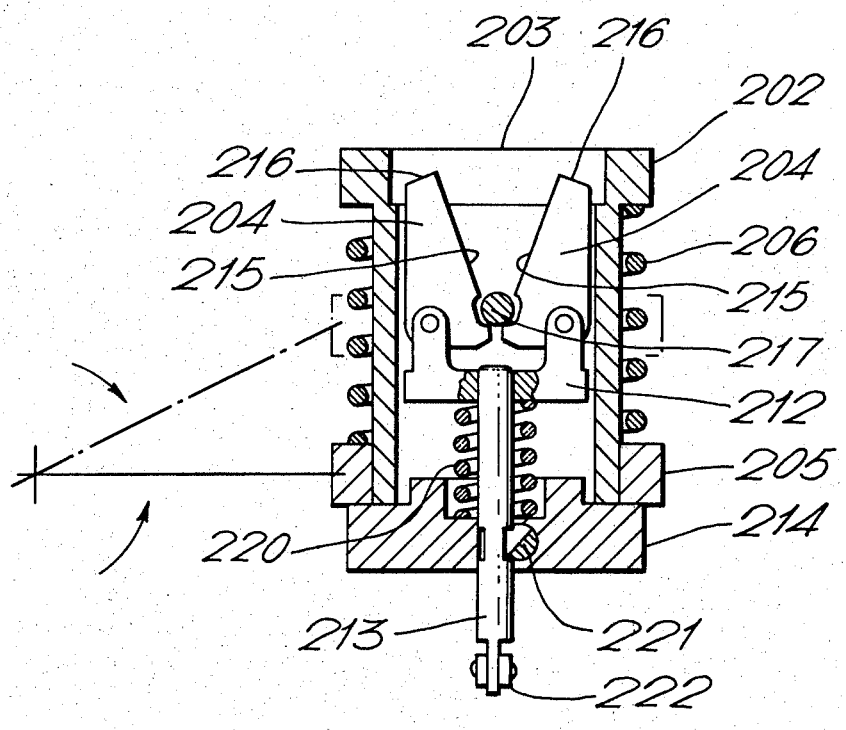
Figure 6:
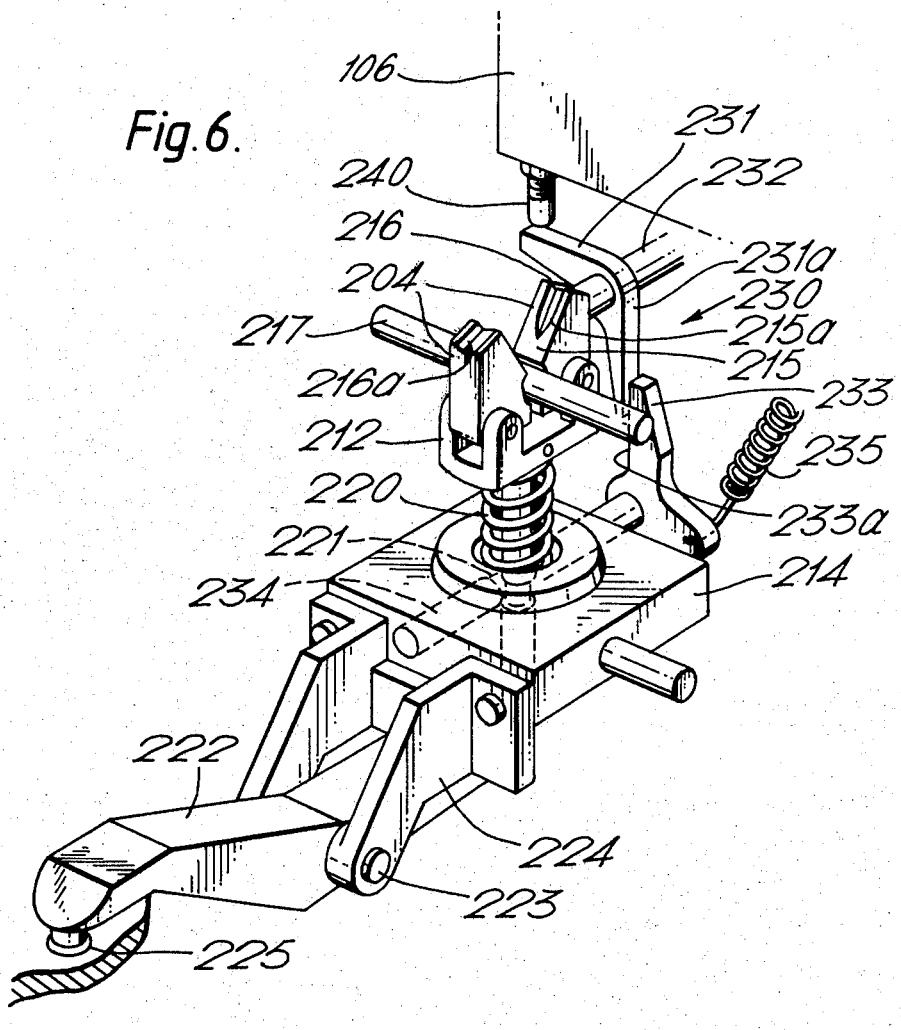
Figure 7:
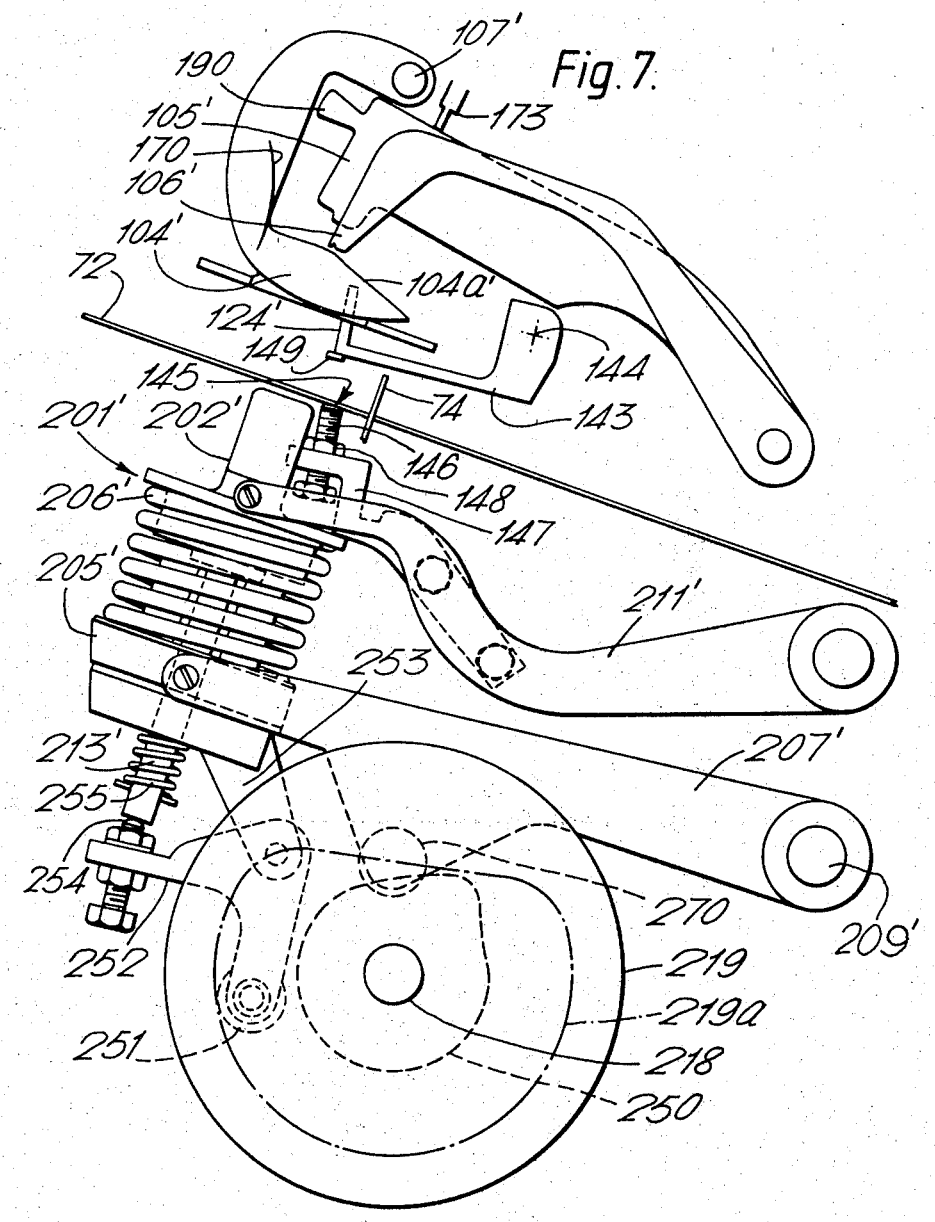

In order that the invention may be more readily understood, reference will now be made to the accompanying drawings in which:

FIG. 1 is a schematic side elevation of an exemplary form of photocopier incorporating a finisher incorporating a stitcher according to this invention, FIG. 2 is a schematic view illustrating the principles of one embodiment of stitcher of this invention suitable for use in the finisher of FIG. 1, FIG. 3 is a scrap view of the stitcher shown in FIG. 2 illustrating schematically the relationship of various parts of the stitcher, FIG. 4 is a schematic perspective view of the clincher showing the drive therefor, FIG. 5 is a sectional view of the clincher showing the clincher ear drive, FIG. 6 is a further perspective view of the clincher, with the clincher housing omitted, showing in greater detail the drive mechanism for the clincher ears, and FIG. 7 is a side elevation of a second embodiment of stitcher according to the invention suitable for use in the machine shown in FIG. 1.

Referring to FIG. 1 there is shown an automatic xerographic reproducing machine 10 having a finisher 70 incorporating a stitcher 100 according to this invention. The copying machine 10 is capable of producing either simplex or duplex copies in sets from a wide variety of originals which may be advanced in recirculating fashion by recirculating document apparatus 12 described in U.S. Pat. No. 3,556,512. Although the present invention is particularly well suited for use in automatic xerography, the apparatus generally designated 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station D from sheet registering apparatus 34 in synchronous relation with the image on the drum surface. The copy is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the finisher 70 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The finisher 70 comprises a tray 71 having a base or support surface 72 inclined downwardly in the direction of sheet travel towards a registration corner defined by registration fences 74, 75 extending along the lower edge and one side of the tray. Above the upper end of the support surface is arranged a pair of coacting sheet feed rolls 64, 65 arranged to receive sheets fed along path 63 by pinch rolls 61, 62. From the feed rolls 64, 65, a sheet is directed by guide throat 78 towards the tray 71. A corner registration device 79 such as a paddle wheel like that described in U.S. Pat. No. 3,669,447 is arranged over the surface 72 to urge the sheets S into the registration corner to position them for receiving a stitch from the apparatus 100. The registration fence 74 is rotatable about an axis 74*a* so that it may be retracted for ejection of bound sets SS into a collection tray 69. Any suitable ejection mechanism, such as drive rollers, may be employed.

Referring now to FIGS. 2 and 3 of the drawings, the stitcher 100 comprises a stitcher head 101, a reel 102 (FIG. 1) from which wire W is supplied via a dancer (not shown) to the head 101 and an active clincher 201. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing 202 having a clamping surface 203 by which a set SS may be clamped against the underside of the stitcher head 101 and containing clinch ears 204 arranged to receive and act upon staple legs driven through the set and into the housing through a slot in the surface 203.

In FIG. 2, the clincher 201 is shown in its operative position with a set SS positioned against the head 101 which is fixed in position above the compiler tray. It will be understood, however, that during compilation of the set, the clincher is lowered so that the clamping surface 203 is below the support surface 72 of tray 71. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing via a compression spring 206, being moved through a fixed distance by a lever 207 (see FIG. 4). The spring 206 is positioned between the force applying ring 205 and a shoulder 208 and the lever 207 which is arranged to pivot about axis 209 is actuated by a cam (not shown) which acts on its free end 207*a*. As shown in FIG. 4 the other end of the lever is bifurcated to form a yoke 207*b* which is pivotally connected to the force ring 205. The clincher housing 202 is supported and guided by a pair of arms 211 pivotally connected between the housing and the frame of the stitcher. The mechanism 210 in addition to accommodating varying set thicknesses, varies the clamping pressure applied to the set as a function of set thickness. Thus, the thinner the set the less the compression of spring 206 and the less the clamping force applied. The clincher ears 204 are positioned in fixed relation to the housing 202 so that they are always presented to the set in the same relation regardless of the set thickness.

The wire advancing and cutting mechanism 103 comprises movable wire advancing and cutter blocks 120, 121 and an inhibitor member 124 positioned by the clincher 201 in dependence on the thickness of the set of sheets SS. The blocks 120, 121 include wire diodes 122, 123 which grip the wire only against movement relative to the respective block in the direction opposite the wire advancing direction. Thus, the diodes grip the wire when the blocks are moved to the left but allow each block to be moved to the right along the wire while the other block holds the wire.

At the start of a wire feed cycle, the blocks 120 and 121 are positioned as shown in dotted lines in FIG. 1. To feed the wire W, the advancing block 120 is moved to the left, its diode 122 gripping the wire, to advance the wire past the rest or start-of-cycle position of the cutter 125 by a distance made up of a constant (crown length plus twice clinch length) plus the set thickness and the cutter block is retracted from its rest position by a distance equal to the set thickness. These movements and thus the length of wire W presented to the stitcher head 101 for severing by the cutter 125 are determined by the inhibitor member 124 which limits the movement of the blocks 120, 121, according to the thickness of the set. The blocks 120, 121 are shown in full lines in their final positions at the end of a wire advancing movement. As the mechanism recycles to its start position (which takes place at the end of the complete stitching cycle) the cutter block 121 returns to its rest position pulling the wire with it—so that the wire end is always in the same position at the start of a feed cycle—and the advancing block 120 traverses back along the wire to its rest position.

While the inhibitor member 124 may be directly connected to the clincher housing 202 as schematically represented in FIG. 2, other arrangements are possible. Thus in a second embodiment as shown in FIG. 7, the inhibitor member 124' is carried on an arm 143 pivoted to the stitcher head at 144 and is positioned by means of an actuator 145 mounted on one of the clincher housing guide arms 211'. As shown the actuator is adjustable for correctly setting the mechanism and comprises a bolt 146 threaded through a bracket 147 and locked into position by a nut 148. While the clincher is retracted, the inhibitor is supported by a limit stop 149.

The embodiment of FIG. 7 also includes a modified drive for the force ring 205' in which as a space-saving measure, the lever 207' carries a cam follower 270 intermediate the force ring 205' and pivot axis 209' which is controlled by a face cam 219 the centre-line of the guideway of which is shown by the dash-dot line 219*a*. The cam 219 is mounted on a cam shaft 218.

The length of wire presented to the stitcher head 101 by the mechanism 103 is cut, formed and driven in the following manner. While the anvil 104, which is pivotally mounted at 107 and biassed to its start-of-cycle position by a spring 108 as shown in FIG. 2, is held against movement, the driver 106 is moved downwardly against the wire to clamp it in position on the anvil. The former elements 105 then start moving downwardly. Initial movement of the former operates the cutter 125 through actuator 109 to sever the required wire length and further movement thereof shapes the wire about the anvil 104 into a generally U-shape. In order to accommodate the wire during this operation, the formers have guide grooves 110 along their inner faces. At the end of the forming operation the former is in its lower limit position with the lower ends of the former elements 105 below the underside of the anvil 104 and adjacent the set. The driver 106 is now driven downwardly, pivoting the anvil about its axis 107, to drive the formed staple. As seen in FIG. 3, the anvil includes a sloping surface 104*a*. During the driving operation, the anvil surface 104*a* forms a support for the crown of the staple. Similarly the former elements serve to support the legs of the staple in the grooves 110 during the driving movement.

It will be realised from the foregoing that the anvil must be held against movement during the cutting and forming stage but be pushed out of the way during the driving stage. This may be achieved by using a spring 108 which is strong enough to hold the anvil stationary during cutting and forming. However, this requires that the force available to drive the driver must be sufficient also to overcome the resistance of the spring. It is preferred therefore that as described with reference to our copending Ser. No. 106,324 filed concurrently herewith, the anvil be held locked in position during the cutting and forming stage and released by the former 105 at the end of its travel whereby only a relatively light spring 108 is required which is sufficient to return the anvil to its start-of-cycle position and to ensure that the anvil supports the staple crown during the driving stage. One way of achieving this is shown in FIG. 7 in which the anvil is geometrically locked in position during the cutting and forming steps by arranging the pivot axis 107 above the line of pressure engagement between driver and anvil, the lock being released by a projection 190 on the former engaging an actuator surface 170 on the anvil support area.

As described above, the stitcher has a two stage driver action in which following wire feed a first stage motion operates to grip the wire W against the anvil 104 during cutting and forming and a second stage motion acts following forming to effect driving of the formed staple. A mechanism suitable for this operation based on pivoted motions which first holds the wire against the anvil and then provides the driving motion all from one continuous input lever travel is described in our copending Ser. No. 106,421 filed concurrently herewith.

The ends of the staple legs are turned over and wiped flat against the underside of the set by the clincher ears 204. The clincher 201 is operated as described more fully in our copending Ser. No. 106,197 filed concurrently herewith so that the stable legs having passed through the set move through air and meet no further resistance during driver travel. This is achieved by arranging the clincher ears out of the paths of the staple legs during driver travel so that leg wander is accommodated wholly within the clinch ears by profiling the ears with the groove wide enough to accommodate the maximum leg wander anticipated. The drive to the clincher ears may be by a spring which is loaded during return motion of the clincher housing at the completion of a stitching operation as more fully described with reference to FIGS. 5 and 6, the clinch ears being held latched in the position shown in FIG. 2 prior to the operation thereof, or by a cam drive 250 as described with reference to FIG. 7.

One embodiment of clincher ear drive is shown in FIGS. 5 and 6 in which the clincher ears are driven by a spring 220 which is loaded during return motion of the clincher housing at the end of a stitching operation, the ears 204 being held latched in the position shown by a latch 221. The ears themselves are pivotally mounted on a bracket 212 carried by the clincher rod 213 and the spring 220 is a compression spring surrounding the rod 213 and extending between the bracket 212 and the base 214 of the clincher housing 202. The ears have V-grooves 215*a*, 216*a* in their facing surfaces 215 and upper surfaces 216 respectively and these are suitably profiled as described more fully in Ser. No. 106,197. When the latch 221 is released the spring drives the bracket 212 upwardly and the ears are raised into a final position (not shown) in which their facing surfaces 215 meet and their upper surfaces 216 are generally horizontal and flush with the clamping surface 203, simultaneously pivoting about bracket 212 and turning about pivot bar 217 which is fixed to the clincher housing. During this movement the staple (stitch) legs are gathered and aligned by the V-grooves 215*a* and bent over and wiped flat against the underside of the set initially by the grooves 215*a* and then by the grooves 216*a*. For loading the spring, the lower end of the rod 213 is pivotally connected to a lever arm 222 which isitself pivoted at 223 to a bracket 224 secured to one side of the clincher housing 202. A fixed stop 225 limits downward movement of the free end 222*a* of the lever arm 222. As the clincher housing is lowered at the end of a stitching operation, the end 222*a* of arm 222 is arrested by the stop 225 so that the clincher rod 213 is drawn downwardly relative to the housing returning the ears 204 to the positions shown and loading the spring 220. The latch 221 is operated off the driver 106 via trip mechanism 230. This comprises a master crank lever 231 pivoted to the stitcher head frame about a fixed axis 232 and a slave lever 233 mounted for rotation with a shaft 234 carried in bearings in the clincher housing base 214 and incorporating latch 221 as a D-section portion thereof. The slave lever 233 is biassed into engagement with the master lever 231 by a spring 235 and the faces 231*a*, 233*a* of the levers slide over each other as the clincher housing is raised and lowered during stitching.

In operation, as the clincher housing 202 is raised to clamp a set against the stitcher head, the clincher ears 204 remain latched, the lever 233 sliding along lever 231. The master lever 231 is pivoted to rotate the slave lever 233 and unlatch the clincher rod by an actuator 240 on the driver 106 so that the operation of the clincher ears is timed off the driver. Since the master lever 231 has its pivot axis fixed relative to the head, the timing is essentially unaffected by set thickness. Specifically, the actuator 240 is arranged to unlatch the clincher rod 213 only after the staple has been completely driven through the set with its crown against the upper face of the set.

A second embodiment of clincher ear drive is illustrated in FIG. 7. Here, the clincher rod 213' is driven by an edge or ramp cam 250 mounted on the same drive shaft 218 as, and alongside, the cam 219 which drives the force-ring lever 205'. The drive to the clincher rod from the cam 250 is effected by a roller follower 251 mounted on one end of a crank arm 252 pivoted to a bracket 253 depending outwardly from the clincher housing 202'. The other end of the crank arm carries a stop 254 which engages the bottom end of the clincher rod 213'. As shown, the stop 254 is adjustable to permit setting of the clincher ear movement. The clincher ears 204' are biassed to their open, retracted position by a spring schematically represented at 255. The cam shaft 218 is driven in synchronism with the head 101 drive and the cam 250 is disposed so that the clincher rod is driven only after the formed staple has been completely driven through the set. It will be noted that by using a drive arrangement as shown with the face cam 250, variations in set thickness are accommodated without affecting the timing (except to an insignificant degree caused by slight variations in the position of the cam follower 251 to cam 250) of the clincher ear movement relative to that of the driver.

Whilst specific embodiments of the invention have been described above it will be understood that various modifications may be made to the specific details referred to herein without departing from the scope of the invention as defined in the appended claims. Thus, the principles of this invention although described in relation to a flat bed stitcher may equally be applied to a saddle stitcher.

Further, while in the apparatus described above the stitcher is fixed in position, it may be movable for varying the position of the stitch or for inserting more than one stitch in a set. Also, two or more stitchers according to the invention, which may themselves be movable, may be operated in tandem, in which case various of the drive elements may be common to avoid duplication.

It will also be understood that while in the embodiments described, the stitcher head is fixed, the clincher could be fixed and the clamping means be formed by the sheet receiving surface of the head itself.

It will further be understood that although the embodiments of stitcher described and illustrated show the stitcher head abovethe clincher, the stitcher may be arranged in any suitable orientation and specifically the clincher may be arranged over the stitcher head.

For clarity, it is to be noted that the term staple is used herein to mean either a wire-fastener which is pre-formed outside the stitching machine or one which is formed within the machine.

Although in the embodiments described herein the stitcher head 101 and the associated clamping surface are fixed and the clincher 201 and its associated clamping surface are movable, other arrangements are possible. Thus, the clincher may be stationary or both the stitcher head and the clincher may move.

What is claimed is:

1. A stitcher for binding sets of sheets having a stitcher head for driving a staple through a set and an active clincher mechanism, the improvement including means for moving the clincher mechanism to an operative position towards and away from the stitcher head and into clamping relationship relative thereto with a set clamped therebetween, and to an inoperative position, said clincher mechanism including a pair of clinching ears adapted to be applied to the legs of a staple, spring drive means for driving said ears of the clincher to affect bending of the legs of the staple, said spring being loaded during movement of the clincher away from the head, and means for effecting actuation of the clincher ear drive in timed relation to the driving of a staple.

2. A stitcher according to claim 1 in which the head has a fixed operative position and the movement of the clincher is variable to accommodate varying set thicknesses.

3. A stitcher according to claim 1 including a latch for latching the clincher ear drive following loading of the spring, said latch being released during the next staple driving action by the staple driver.

4. A stitcher according to claim 3 in which said latch is released by an actuator on the driver which acts at the end of its travel when the staple is fully driven.

5. A stitcher according to claim 3, wherein said clincher includes a housing and said clincher ears are carried on one end of a rod slidably mounted in said clincher housing, the spring fitting around said rod.

6. A stitcher according to claim 5 wherein said latch, in the spring loaded condition of the clincher ear drive, engages a shoulder formed on the clincher rod.

7. A stitcher for binding sets of sheets having a stitcher head for driving a staple through a set and an active clincher movable towards and away from the stitcher head between an operative position in which a set is clamped thereby relative to the stitcher head and an inoperative position, the improvement including spring drive means for driving the ears of the clinches, said spring being loaded during movement of the clincher away from the head, means for effecting actuation of the clincher ear drive in timed relation to the driving of a staple, a latch for latching the clincher ear drive following loading of the spring, said latch being released during the next staple driving action by the staple driver, said latch being released by an actuator on the driver at the end of its travel when the staple is fully driven, and a pair of coacting levers, said actuator being operable on one of said pair of coacting levers, the other of which carrying said latch, said levers being relatively movable to accommodate variations in set thickness.

* * * * *